US005315837A

United States Patent [19]

Lego

[11] Patent Number: 5,315,837

[45] Date of Patent: May 31, 1994

[54] PROCESS FOR SUPPLYING COLD TO AN OPEN REFRIGERATED ENCLOSURE FOR DISPLAY AND SALE OF FRESH PRODUCTS IN A SUPERMARKET

[75] Inventor: Francois Lego, Ste Luce Sur Lorie, France

[73] Assignee: M. C. International, Velizy, France

[21] Appl. No.: 12,925

[22] Filed: Feb. 3, 1993

[30] Foreign Application Priority Data

Feb. 4, 1992 [FR] France ..... 9201225

[51] Int. Cl.[5] ..... A47F 3/04

[52] U.S. Cl. ..... 62/89; 62/255; 62/427; 34/294

[58] Field of Search ..... 454/252, 296, 306; 62/89, 255, 427; 34/218, 224

[56] References Cited

U.S. PATENT DOCUMENTS

| | | | |
|---|---|---|---|
| 1,455,846 | 5/1923 | Lewis | 454/306 X |
| 3,110,286 | 11/1963 | Clute | 454/252 X |
| 3,233,422 | 2/1966 | Kobrin | 62/155 |
| 3,363,532 | 1/1968 | Horneff | 454/296 X |
| 3,499,295 | 3/1970 | Brennan | 62/81 |
| 3,572,052 | 3/1971 | Toth | 62/278 |
| 3,719,136 | 3/1973 | Criddle | 454/306 X |
| 3,812,684 | 5/1974 | Brown | 62/89 |
| 3,949,522 | 4/1976 | Kehl et al. | 454/306 X |

FOREIGN PATENT DOCUMENTS

| | | |
|---|---|---|
| 2201676 | 1/1972 | Fed. Rep. of Germany . |
| 1316616 | 12/1962 | France . |
| 1468833 | 1/1967 | France . |
| 1568856 | 4/1969 | France . |
| 2011045 | 2/1970 | France . |
| 2042663 | 2/1971 | France . |
| 2295380 | 12/1974 | France . |
| 1215981 | 12/1970 | United Kingdom . |
| 1506655 | 4/1978 | United Kingdom . |

*Primary Examiner*—William E. Tapolcai
*Attorney, Agent, or Firm*—Fisher, Christen & Sabol

[57] ABSTRACT

Disclosed is a process for supplying cold to at least one refrigerated enclosure particularly an open enclosure for the display and sale of fresh products in a supermarket, characterized in that:

a) in the sales point are disposed said open enclosures provided in manner known per se with cold air dispensing and recovery nozzles, passing through the interior of the enclosures, the air streams sweeping the products displayed and the air heating up by taking calories exchanged from the products;

b) there is positioned in a zone offset with respect to said enclosures and chosen for its convenient access, an air cooling plant principally comprising an evaporator of refrigerant liquid-gas and a ventilator, this plant is furthermore supplied with refrigerant by a refrigerating unit;

c) the cold air coming from the evaporator of said plant is entrained by forced circulation through appropriate pipes towards said enclosures, the cold air coming from the air cooling plant being delivered to cold air dispensing nozzles serving the enclosures, air recovery nozzles being connected via recycling pipes to said plant for returning the air reheated by passage in the enclosure and returned towards said evaporator to be cooled therein.

17 Claims, 5 Drawing Sheets

PROCESS FOR SUPPLYING COLD TO AN OPEN REFRIGERATED ENCLOSURE FOR DISPLAY AND SALE OF FRESH PRODUCTS IN A SUPERMARKET

FIELD OF THE INVENTION

The present invention relates to the domain of installations, more specifically refrigerated enclosures, such as display windows, chests and shelvings, which are installed in sales points, particularly self-service stores and supermarkets. These refrigerated enclosures offer a view of fresh products for sale and enable the consumer to help him/herself.

BACKGROUND OF THE INVENTION

In super- or hypermarkets, cabinets of the shelving type are known, which comprise a back from which issue superposed shelves are surmounted by a top and rest on a base, the assembly which constitutes an open enclosure through which a flow of cold air passes to ensure refrigeration and good conditions for conservation of the products.

Display furniture is also known, particularly for products of the "delicatessen" type, which comprises a display surface completed by a window preferably curved rearwardly. This surface has a flow of cold air passing thereover, as hereinabove, to maintain the products at a low temperature compatible with good conditions of conservation.

In presently known systems, a decentralized refrigerating unit is used, for example in service premises, which, in conventional manner by compression (condensation) and expansion (evaporation), is able to take from the outside environment the calories necessary for the latent heat of vaporization of the refrigerating liquid and consequently, the production of cold. The condensation unit is connected by appropriate conduits to each of the containers to which it sends the refrigerating fluid in the liquid state, with the interposition of an electrovalve controlled by a thermostat, the electrovalve being opened or closed as a function of the needs of cold in the assembly which the enclosures served.

The refrigerating fluid passes from the liquid phase to the vapor phase via an evaporator which has a constantly circulating air flow passing therethrough. The air flow passes over the finned tubes of the evaporator towards the back and the top of the cabinet from which it is distributed via orifices and nozzles to sweep all the products located in the open enclosure. The air is recovered at the base of the cabinet and reheated by passage over the stored products which are returned on the evaporator.

As the temperature on the wall of the evaporator is lower than 0° and the circulating air is laden with humidity, this results in the formation and accumulation of frost which must be periodically eliminated with the aid of electric resistors. During the periods of defrosting, with production of calories by the electric resistors, circulation of the refrigerating liquid and ventilation is interrupted. This brings about an undesirable rise in the temperature within the cabinet and of the products that it contains.

According to another method, defrosting is obtained by maintaining ventilation and by stopping the circulation of the refrigerating fluid, for example, for 30 to 45 minutes every 6 hours.

FIG. 1 of the accompanying drawings schematically shows a cabinet 3 which comprises a plurality of shelves 3*a*, 3*b*, 3*c* and which is supplied with refrigerant from a refrigerating unit.

The latter comprises a compressor 1*a*, a coil 1*b* for evacuating the heat resulting from the compression and a store 1*c* of refrigerating fluid in the liquid state (high pressure).

This refrigerating fluid reaches the cabinet 3 via appropriate conduits, after passage via an electrovalve 2 as a function of needs of cold as indicated hereinabove. The refrigerating fluid then passes through the pressure reducing valve 4 controlled by the thermostatic train 5 to arrive at the evaporator 6 where cold is produced by passage of the refrigerating fluid from the liquid phase to the gaseous phase.

Although this technique has certain advantages, it does present several drawbacks:

(1) Each cabinet presents a large number of refrigerating components, which increases their cost and in the event of momentary breakdown, makes necessary interventions on these components difficult. In the case of a breakdown, the cabinets must be emptied and the interventions must be carried out at night or on Sundays, which represents long and expensive handling operations thereby handicapping the conditions for exploitation.

(2) It is not possible to monitor the concealed components directly and visually because they are generally located behind the rear face or in the back of the cabinet.

(3) The system does not allow for filtration of the circulating cold air.

(4) The possibilities of change in the arrangements and architecture of the interior decoration of the stores are reduced and also expensive.

(5) Finally, the periodic defrostings cause undesirable rises in temperature which increase the refrigerating balance of the exploitation and are detrimental to the conservation of the products.

SUMMARY OF THE INVENTION

An object of the present invention is to overcome the drawbacks mentioned above while conserving the advantages of the conventional system, particularly the reliability of the proved components and the easy use thereof.

In accordance with a first object, the invention limits the number of technical components.

According to a second object, the invention separates the function of display (at the level of the cabinets) from the thermal function (production of cold).

According to yet another object, the invention allows technical interventions without having to empty the cabinets, and it allows for permanent visual monitoring of the components.

The invention also ensures treatment of the air and the purification thereof before being recycled.

Finally, the invention makes it possible to change the cabinets and allows for the periodic renewal of the stores by adapting the interior decoration and architecture to the current fashion or to the exploiter's taste without modifying or discarding the technical installations previously integrated in the display cabinets.

To that end, the present invention relates to a process for supplying cold to at least one open refrigerated enclosure for the display and sale of fresh products in a self-service store, in which:

a) there are disposed in the sales premises said open enclosures provided with nozzles which dispense and recover cold air, which passes through the interior of the enclosures, the air stream sweeping the products displayed and the air being heated up by taking calories from the products;

b) there is positioned in a zone offset with respect to said enclosures and chosen for its convenient access, an air cooling plant which comprises an exchanger and a circulator and is furthermore supplied with refrigerant by a refrigerating unit or with cold-transfer fluid. The process comprises the step of entraining by forced circulation the cold air coming from said plant towards said enclosures, the cold air is delivered to cold air dispensing nozzles which open out at the top of the enclosure and the heated air is recovered at the base of the enclosure each time by two twinned nozzles or respectively two twinned dispensing nozzles and two twinned recovery nozzles. The two nozzles in each twinned assembly comprise a reversed direction of circulation, from one nozzle with respect to the other, each nozzle terminates in a cul-de-sac, the cul-de-sacs are in a head-to-tail relationship.

The invention also relates to an installation which carries out the process mentioned hereinabove which ensures the refrigeration of open enclosures that display fresh products for sale in self-service stores. The installation comprises at least one open enclosure which receives the products on supporting members and means for distributing and recovering the heated air which passed through the interior of the enclosure. The installation is characterized by dispensing and recovery nozzles which serve each enclosure. They are connected by means of the forced circulation of cold air to at least one air cooling plant of known type and comprise a ventilator-evaporator assembly of refrigerant fluid (liquid-gas). The air cooling plant is offset with respect to said enclosures, which are supplied, not with refrigerant liquid, but with cold-transfer air. The air cooling plant serves a plurality of enclosures by a network of cold air distributing pipes which arrive at dispensing nozzles which serve each enclosure and via recovery pipes which connect each enclosure to the air cooling plant. The recycled air coming from each enclosure is returned on the evaporator of the air cooling plant for cooling thereof and to depart at low temperature towards the enclosures, and the installation comprises two twinned air cooling plants which allow alternate functioning, particularly for the purpose of operations of defrosting, maintenance and repair.

BRIEF DESCRIPTION OF THE DRAWINGS

The invention will be more readily understood by reading the following description with reference to the accompanying drawings, in which.

As described hereinbefore, FIG. 1 schematically shows a conventional installation.

DETAILED DESCRIPTION OF THE DRAWINGS

According to the invention, in the process and device, the enclosure to be refrigerated is in all respects identical in its functional finality of display of fresh products to the devices which are presently known, whether it be a question of vertical cabinets with superposed shelves or of horizontal ones with curved window.

Inside each enclosure, the circulation of cold air is effected in a conventional manner. The cold air is blown in from the upper part and recovered in the lower part, to be recycled towards an air treatment plant in which the air is cooled.

In this concept, the cold-air production plant is independent of the cabinets to which it is connected by outward air-circulation pipes and return air-circulation pipes, and the plant may therefore be offset in a zone which is chosen for its convenient access and which may possibly be remote from the cabinets served. This plant might be implanted, for example, beneath or on the roof, in service premises, in the basement or in the upper space above the false ceiling of the store.

Figure 1:
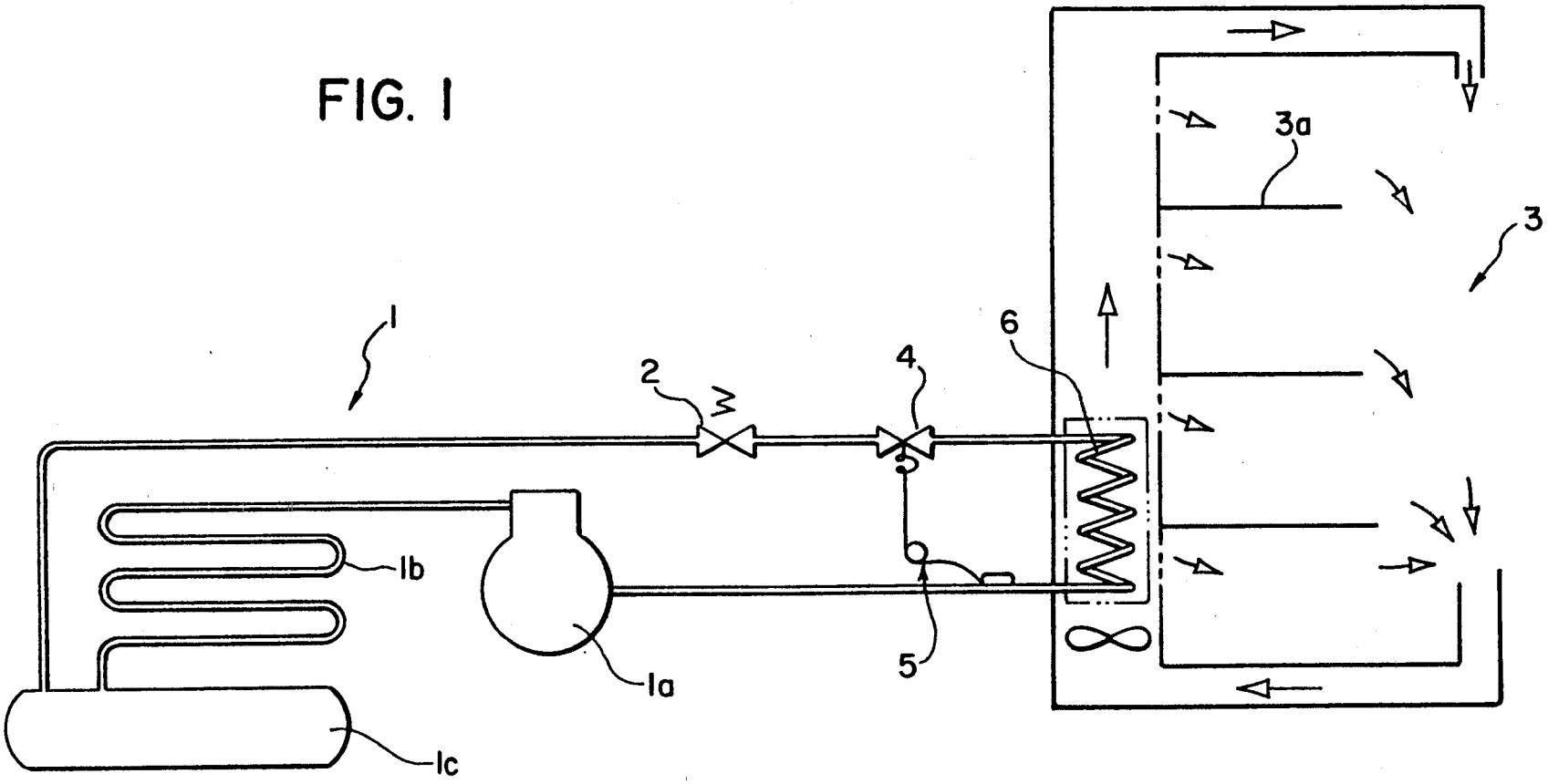
Figure 2:
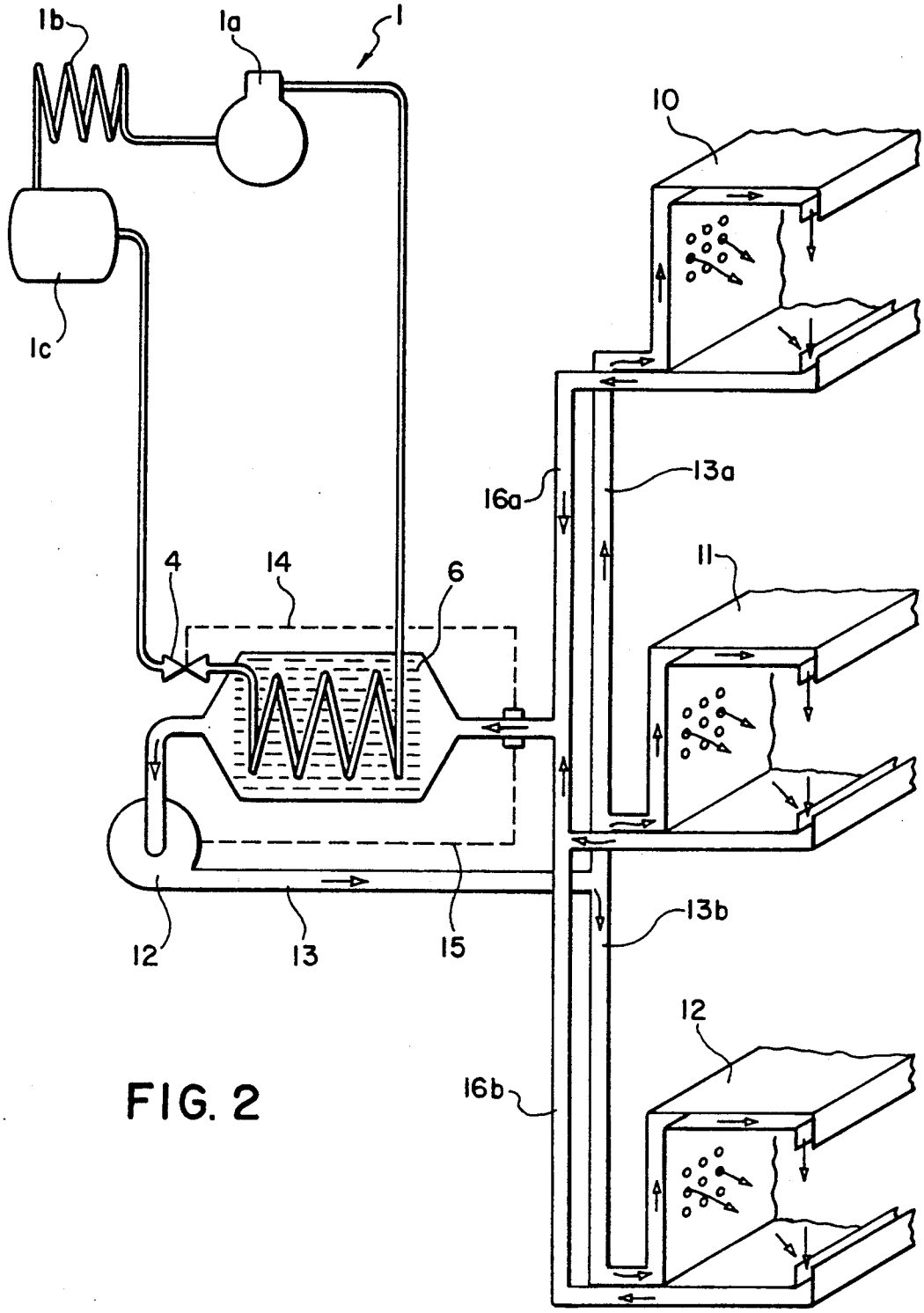
FIG. 2 shows a diagram of an installation according to the invention.

Referring again to the drawings, FIG. 2 schematically shows the air cooling plant which serves the decentralized and peripheral cabinets via a network of air-circulation pipes. In FIG. 2, the same references have been used to designate the same members as in FIG. 1. These members are conventional and their implementation is not specific to the invention which is oriented to the arrangement of the technical elements. All of the refrigerating components are offset and centralized at the level of the air cooling plant, and therefore, the cabinets in that case are no more than a simple air-conditioned framework, empty of any technical assembly.

FIG. 2 illustrates, under reference 1, a refrigerating plant composed, as indicated hereinbefore, of a compressor 1*a* which supplies, through the coil 1*b* for the loss of the calories associated with the compression and the passage from vapor phase to liquid phase, the reservoir 1*c* of refrigerating fluid in the liquid state and under high pressure in this reservoir.

This reservoir supplies through the pressure reducing valve 4 the exchanger or evaporator 5 in which the refrigerating liquid evaporates by taking from the medium which traverses the exchanger 6 the calories needed to compensate the latent heat of vaporization.

The circuit of the refrigerating fluid in the gaseous state then joins the compressor 1*a*.

The exchanger 6 is here streamlined to allow the passage of air which is intended to supply each of the cabinets 10, 11 and 12, which are offset and contained within the arrangement of the store, while the refrigerating plant 1 is located in remote premises chosen for its convenience. The air cooled after passage over the exchanger 5 is circulated by the circulator or turbine 12*a* and from there is sent via a principal conduit 13 towards cabinets 10, 11, 12 through branches 13*a*, 13*b*.

The pressure reducing valve 4, like circulator 12*a*, may advantageously be controlled by circuits 14, 15 from thermic probes which detect the characteristic data of the recycled air on the return conduits so as to adapt the production of cold by acting on the one hand on the pressure reducing valve (quantity of refrigerating liquid admitted into the evaporator) and on the flow rate (speed of circulation of the circulator 12*a*), this is a function of the refrigerating needs in the cabinets.

The number of cabinets is obviously not critical and they have been shown schematically here as three in number. A refrigerating plant is shown which is able to be calculated as a function of its power and air flow rate, and is able to supply cold air to all the cabinets which display fresh products in a hypermarket.

FIG. 2 also shows that the cold air coming from the plant blown in at the top of the cabinet and along the rear wall (by way of example) is recovered at the base and through the conduits 16*a*, 16*b* to join the central recovery column 16 which conveys all the recycled air from the base of the cabinets towards the plant and more especially towards the exchanger 6.

Figure 3:
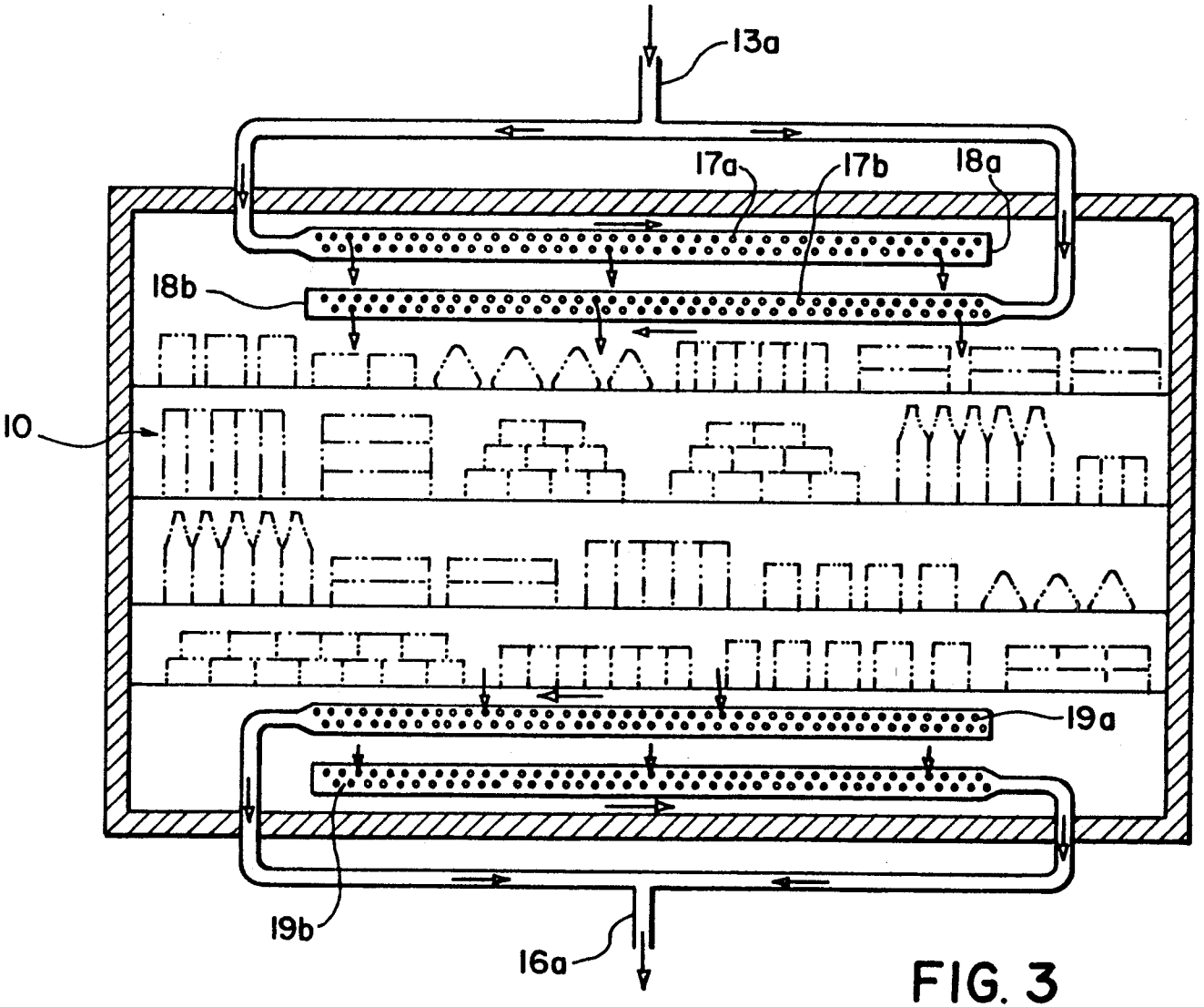
FIG. 3 shows a diagram which illustrates the head-to-tail arrangement of the dispensing and recovery nozzles.

According to a development of the invention shown in FIG. 3, it is seen that, having arrived on an individual cabinet 10, the cold air distribution conduit divides into two parallel, twinned nozzles, each nozzle 17*a*, 17*b* which terminates in a cul-de-sac 18*a*, 18*b* near which the residual pressure is considerably reduced.

As shown in FIG. 3, the two dispensing nozzles are disposed head-to-tail so that the direction of circulation in each nozzle is opposite the direction of the preceding nozzle.

It will be understood that, under these conditions, an automatic self-balancing of the flow rates is obtained all along the two twinned nozzles since, at one end, a nozzle close to its inlet will tend to deliver a larger quantity of air given the pressures which prevail therein. While, as one approaches the terminal cul-de-sac, the pressure decreases due to the air which has already escaped, with the result that, along each nozzle, the decreasing gradient of the pressures determines a decreasing gradient of the flow rates.

However, as the two gradients are inverse, they complete and complement each other at any point. The result is that the total flow rates are equal all along the two twinned nozzles.

The number of nozzles is not critical, but since one monodirectional nozzle must be associated with an inverse monodirectional nozzle, the number of the nozzles must be even.

Two identical nozzles 19*a* and 19*b* are found at the base of the cabinet. These nozzles ensure recovery of the air which passed through the enclosure (and was partially drawn from the ambient medium). As set forth hereinabove, the two recovery nozzles are disposed head-to-tail, thus, their inlet flow rate will be identical all along the length of the cabinet.

Thus, air distributions may be affected with a homogenous flow rate over a great linear length of up to 10 meters, or even 20 meters. Such embodiment is limited only by the section of the pipes which connect the cabinets and the plant; this is a function of the interior decoration and the possibilities of implantation.

Figure 4:
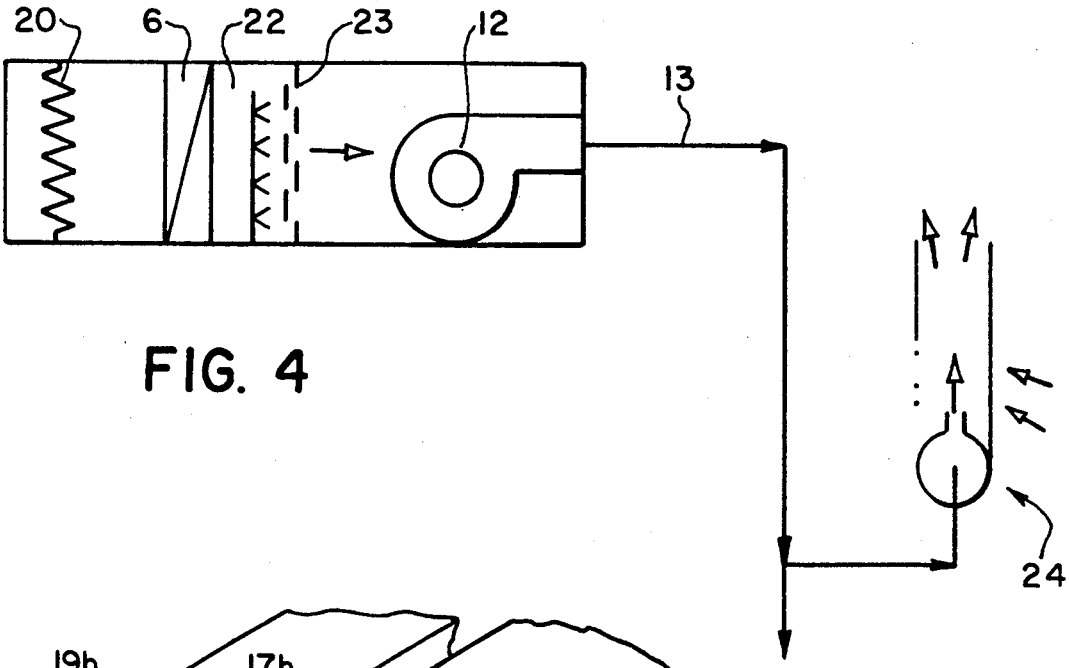
FIG. 4 shows a variant embodiment in which the supply of each enclosure comprises an induction unit for mixing induced secondary air with the primary air which comes from the cooling plant.

According to FIG. 4, the refrigerating plant 1 is completed, apart from the ventilator 12, by means which are located upstream, and comprises a filtration assembly 20. The cold unit is constituted by the evaporator 5, followed by a washing assembly 22, and completed by a mist-collector screen 23.

As set forth hereinabove, the air that has been purified is cooled and circulated by the turbine 12*a* and then blown through pipe 13 towards the network which serves the cabinets. A cooled air which presents characteristics of low temperature and high flow rate (kinetic energy) is used.

In each cabinet, the air which comes from plant 1 is introduced into an induction unit 24 which mixes with primary air which comes from the plant as part of the ambient air, and thereby blows into the cabinet thus refrigerating air of appropriate mean characteristics that is suitably adapted to the needs at every instant.

In this case, overdimensioning of the primary air circulation pipes is avoided. Since large amounts of cold may thus be conveyed in a small section, the primary air is tempered by the reinjection of secondary air when it is used in each cabinet.

This principle is applied by the use of a high-pressure air treatment plant with a reaction ventilator used to obtain a total manometric height of about 400 mm of water column, possibly more if possible. The only objective in the matter is to limit what is strictly necessary in this section of the pipes, thus facilitating the convenience of implantation and of exploitation.

The mechanical strength of the pipes which is often limited in air-conditioning technology is not an imperative nor a constraint here, insofar as said primary air pipes run only over limited lengths.

Figure 5:
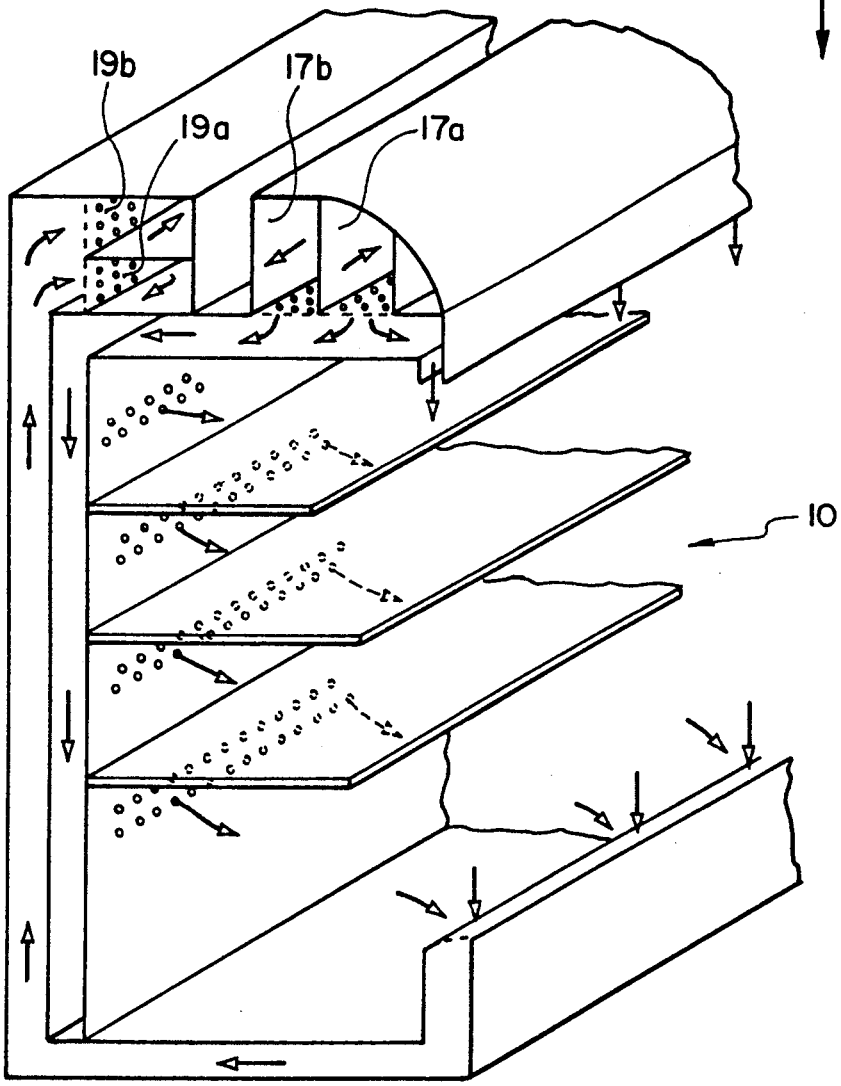
FIG. 5 represents the circulation of the refrigerant air at the level of each open enclosure.

FIG. 5 shows a more detailed view of the circuits which distribute air that is blown in (introduced cold air) and recovered from the cabinet, respectively.

The refrigerated cabinet conserves its traditional appearance, but is surmounted by the air distribution system with nozzles 17*a*, 17*b*, 19*a*, 19*b* mounted head-to-tail and with inverse circulation, which allows for self-compensation of the pressure drops.

Figure 6:
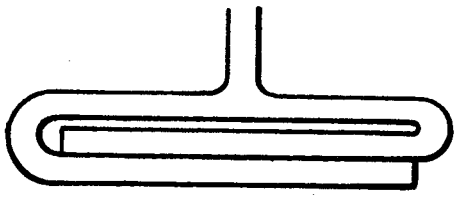
FIG. 6 shows an example of the connection between the reversed nozzles (for dispensing or recovery of the air).

These nozzles advantageously open on the medium that they serve (the interior of the refrigerated cabinet) via a porous surface (non-woven fabric, perforated cloth or honeycomb) which allows the diffusion of the air in the medium served. In accordance with FIG. 6, each nozzle is located at an equal distance with respect to its twin from the plant.

The upper part of the cabinet may be either integrated with the latter or placed (is connected by any means, particularly by screwing) on the cabinet.

Under these conditions, it is very easy to install a novel structure which is adapted to the desired taste and aesthetics, while maintaining the technical superstructure which is solely constituted by the network of the dispensing and recovery nozzles.

In any case, the cabinet is composed only of static elements used to support and display the objects, while it does not comprise a mechanical moving part or any electrical equipment which is capable of causing a breakdown.

Thus, any risk of seeing all the contents of a cabinet lost due to a poorly detected breakdown or the need to transfer all the contents of a cabinet to a cold room for maintenance and repair purposes, is automatically avoided. Said repair is, moreover, rendered particularly awkward insofar as it must be made in situ, therefore in the presence of the consumers, which does not convey a positive image of the establishment, or during the night hours or on Sundays.

Figure 7:
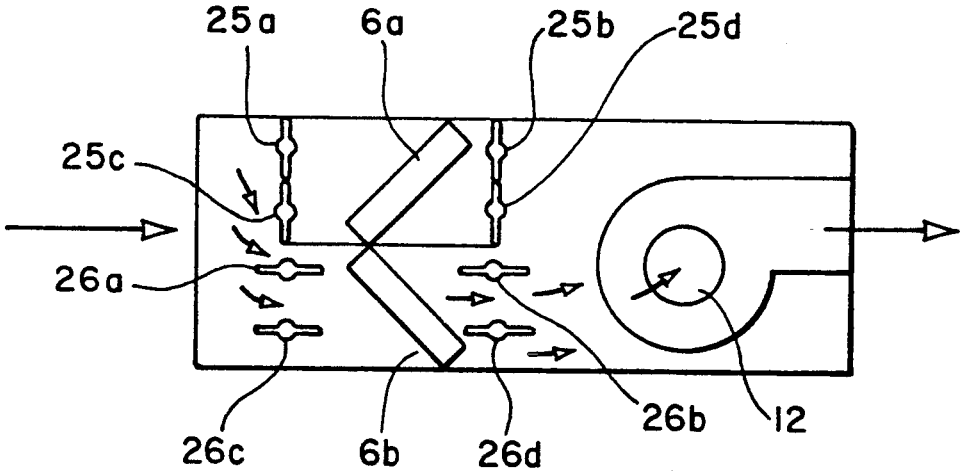
FIG. 7 shows an embodiment which incorporates two evaporators.

FIG. 7 schematically shows two evaporators 6*a*, 6*b* which are isolated by mobile flaps 25*a*, 25*b*, 25*c*, 25*d* (in closed position) and four flaps 26*a*, 26*b*, 26*c*, 26*d* (in open position). Each of the evaporators 6*a* and 6*b* belongs to one of the two twinned plants which equip the installation. While one plant which serves evaporator 6a is isolated, the other plant which serves evaporator 6b is in an active position and thus may perform its function.

During the defrosting phases, it is easy to place the plant which serves evaporator 6b into an inactive position, while the other plant which serves evaporator 6a is immediately put into operation. Flaps 25a, 25b, 25c, 25d are then opened to allow the circulation of the air.

Thus, defrosting may be effected in complete safety without supplying undesirable calories to the installation.

What is claimed is:

1. A process for supplying cold to at least one refrigerated enclosure, which comprises the steps of:

(a) supplying a coolant, wherein said coolant is selected from the group consisting of cold-transfer fluid and refrigerant from a refrigerating unit, to at least one air cooling plant in order to produce cold air;

(b) thereafter, entraining by forced circulation the cold air from the air cooling plant to at least one cold-air dispensing nozzle each of which is positioned in the refrigerated enclosure which is in an area away from the air cooling plant;

(c) thereafter, passing the air throughout the refrigerated enclosure;

(d) thereafter, recovering the air in an even number of twinned recovery nozzles, each nozzle terminating in a cul-de-sac, each nozzle comprising a reversed direction of circulation;

(e) thereafter, passing the air by forced circulation to the air cooling plant.

2. A process as defined by claim 1, wherein said step of supplying is carried out with at least two twinned exchangers disposed at the level of the air cooling plant.

3. A process as defined by claim 1, wherein said step of passing is carried out from an even number of twinned dispensing nozzles, each nozzle terminating in a cul-de-sac and comprising a reversed direction of circulation.

4. A process as defined by claim 1, wherein the supplying of cold to at least one open refrigerated enclosure is for the purpose of storage, display and sale of fresh products in a self-service store.

5. An installation for supplying cold to at least one refrigerated enclosure, which comprises:

(a) at least one enclosure;

(b) at least one cooling plant which is in an area away from the enclosure;

(c) means for the forced circulation of cold air from the cooling plant to the enclosure;

(d) means for distributing the cold air throughout the interior of the enclosure and for recovering the air thereafter, said enclosure comprising cold-air dispensing nozzles and air-recovery nozzles, the number of the dispensing nozzles and recovery nozzles being even, each set of dispensing or recovery nozzles comprising equal numbers of nozzles of opposite direction of circulation direction and being arranged head-to-tail, the flow rates of dispensing and recovery resulting from the sum at any point of the flow rates of the associated nozzles being balanced between the dispensing and recovery nozzles.

6. An installation as defined by claim 5, wherein the supplying of cold to the at least one open refrigerated enclosure is for the purpose of storage, display and sale of fresh products in a self-service store.

7. An installation as defined by claim 5, wherein the enclosure is open.

8. An installation as defined by claim 5, wherein the enclosure is on at least one supporting member.

9. An installation as defined by claim 5, wherein the distributing means is two twinned dispensing nozzles and two twinned recovery nozzles.

10. An installation as defined by claim 5, wherein the air cooling plant is selected from the group consisting of an evaporator of refrigerant fluid and an exchanger.

11. An installation as defined by claim 5, which further comprises two items selected from the group consisting of evaporators, exchangers, twinned air cooling nozzles and a combination of evaporators and exchangers whereby alternate functioning is possible.

12. An installation as defined by claim 5, wherein the alternate functioning is for the purpose of defrosting, maintenance and repair.

13. An installation as defined by claim 5, wherein the at least one air cooling plant comprises means for purifying the circulating air.

14. An installation as defined by claim 13, wherein the purifying means is by filtration or washing or both.

15. An installation as defined by claim 5, wherein the dispensing or recovery nozzles or both diffuse or absorb the air towards or from the open enclosure by a porous surface.

16. An installation defined by claim 15, wherein the porous surface is selected from the group consisting of a woven fabric, a non-woven fabric and a perforated wall.

17. An installation as defined by claim 5, wherein the nozzles are disposed in an independent with respect to a cabinet consisting of a display means so that the cabinet is interchangeable without substantial modification of the dispensing or recovery nozzles.

* * * * *